US008893880B2

(12) United States Patent
Fath

(10) Patent No.: US 8,893,880 B2
(45) Date of Patent: Nov. 25, 2014

(54) FOLDED MERCHANDISING UNIT AND BLANK

(71) Applicant: Altria Client Services Inc., Richmond, VA (US)

(72) Inventor: Scott A. Fath, Richmond, VA (US)

(73) Assignee: Altria Client Services Inc., Richmond, VA (US)

( * ) Notice: Subject to any disclaimer, the term of this patent is extended or adjusted under 35 U.S.C. 154(b) by 33 days.

(21) Appl. No.: 13/731,507

(22) Filed: Dec. 31, 2012

(65) Prior Publication Data

US 2013/0186949 A1 Jul. 25, 2013

Related U.S. Application Data

(60) Provisional application No. 61/581,924, filed on Dec. 30, 2011.

(51) Int. Cl.

| | |
|---|---|
| ***B65D 5/44*** | (2006.01) |
| ***B65D 5/42*** | (2006.01) |
| ***B65D 5/52*** | (2006.01) |
| ***B65D 5/02*** | (2006.01) |

(52) U.S. Cl.

CPC .. *B65D 5/42* (2013.01); *B65D 5/52* (2013.01); *B65D 5/0254* (2013.01); *B65D 5/4208* (2013.01); *B65D 5/443* (2013.01)

USPC ..... 206/45.29; 206/750

(58) Field of Classification Search

USPC ..... 206/45.23, 45.24, 45.29, 738, 739, 206/745–750; 229/122

See application file for complete search history.

(56) References Cited

U.S. PATENT DOCUMENTS 1,669,856 A * 5/1928 Brown ..... 206/45.29

(Continued)

FOREIGN PATENT DOCUMENTS

JP 3142514 U 6/2008

OTHER PUBLICATIONS

International Search Report and Written Opinion of the International Searching Authority issued Mar. 14, 2013 by the ISA/US in corresponding International Application No. PCT/US2012/072286 (12 pgs).

(Continued)

*Primary Examiner* — Bryon Gehman

(74) *Attorney, Agent, or Firm* — Buchanan Ingersoll & Rooney PC

(57) ABSTRACT

A display unit including a front panel, an outer back panel, a bottom panel and side panels; first, second and third connected reinforcing panel sections folded into superposing relation to the outer back panel, the bottom panel and the front panel, respectively, such that a double-panel reinforcement is established on a portion of the display unit; wherein the first, second and third connected reinforcing panel sections are also connected with the front panel along a first fold line defined between the front panel and the third reinforcing panel section; an inner back panel is connected and folded into superposing relation with the outer back panel along a second fold line; and wherein a depth of the display unit is defined between the front panel and the outer back panel and the second connected reinforcing panel section extends an entirety of the depth between the front panel and the outer back panel.

22 Claims, 5 Drawing Sheets

(56) References Cited

U.S. PATENT DOCUMENTS

| | | | | | |
|---|---|---|---|---|---|
| 1,759,470 | A | * | 5/1930 | Tanner | 206/45.29 |
| 2,027,079 | A | * | 1/1936 | Weiss | 206/750 |
| 2,134,964 | A | | 5/1936 | Whitehead | |
| 2,527,028 | A | * | 10/1950 | Myers | 206/750 |
| 3,592,337 | A | | 7/1971 | Phillips, Jr. | |

OTHER PUBLICATIONS

Notification of Transmittal of the International Search Report (Forms PCT/ISA/220 and PCT/ISA/210) and the Written Opinion of the International Searching Authority, or the Declaration (Form PCT/ISA/237) issued on Mar. 14, 2013, in the corresponding International Application No. PCT/US2012/072286. (12 pages).

* cited by examiner

FOLDED MERCHANDISING UNIT AND BLANK

FIELD OF THE INVENTION

A wide variety of different types of merchandising units are used to store, dispense, and display consumer goods at the point of sale. For example, in shops and kiosks, the majority of consumer goods are displayed on free standing counter top displays or similar wall mounted display units. However, it may be desirable to dispense certain items from units provided inside the kiosk or behind the counter top area. In such instance, it may be preferred to allow consumers to still view the goods, but not have them directly accessible by the consumer.

WORKING ENVIRONMENT

It would be desirable to provide a novel merchandising unit for consumer goods and in particular, for smoking articles, which provides increased flexibility in the display and access of the consumer goods at the point of sale.

The present invention relates to a folded merchandising unit adapted to be glued and shipped in a folded state and erected at a point of sale into a merchandising display carton. The invention finds particular application as a merchandising unit for smoking articles.

SUMMARY OF THE INVENTION

Disclosed herein is a merchandising unit, i.e., display carton, particularly suited for packages of smoking articles, as well as smokeless tobacco products, or any other types of consumer goods.

According to one embodiment, a display (merchandising) unit includes a front panel, an outer back panel, a bottom panel and side panels; first, second and third connected reinforcing panel sections folded into superposing relation to said outer back panel, said bottom panel and said front panel, respectively, said first, second and third connected reinforcing panels also being connected with said front panel along a first fold line defined between said front panel and said third panel section; an inner back panel connected and folded into superposing relation with said outer back panel along a second fold line; whereby a double-panel reinforcement of the display unit is established.

A further embodiment provides a method of establishing a double-panel reinforcement of a display unit, comprising establishing a box structure comprising a front panel, an outer back panel, a bottom panel and side panels; folding first, second and third connected reinforcing panel sections into superposing relation to said outer back panel, said bottom panel and said front panel, respectively, said folding including folding along a first fold line defined between said front panel and said third panel section; and folding an inner back panel into superposing relation with said outer back panel along a second fold line.

According to one embodiment, a carton blank is adapted to be glued and shipped in a folded condition and erected at a point of sale into a merchandising display carton. The carton blank comprises a first rectangular panel having first and second short ends and first and second long ends, the first and second short ends being free ends and the first long end being a free end; a second rectangular panel having first and second short ends and first and second long ends, the first long end of the second rectangular panel hingedly connected to the second long end of the first rectangular panel along a first fold line; a third rectangular panel having first and second short ends and first and second long ends; a glue flap having first and second short ends and first and second long ends, the first long end of the glue flap hingedly connected to the second short end of the second rectangular panel along a second fold line, the second long end being a free end, and the first and second short ends being free ends; a first side panel having first and second short ends and first and second long ends, the first long end of the first side panel hingedly connected to the second short end of the third rectangular panel along a third fold line, the second long end of the first side panel hingedly connected to the first short end of the second rectangular panel along a fourth fold line, the second short end of the first side panel hingedly connected to a first dust flap along a fifth fold line and the first short end of the first side panel being a free end; a second side panel having first and second short ends and first and second long ends, the second long end of the second side panel hingedly connected to the first short end of the third rectangular panel along a sixth fold line, the second short end of the second side panel hingedly connected to a second dust flap along a seventh fold line and the first short end and first long end of the second side panel being free ends; a bottom panel having first and second short ends and first and second long ends, the first long end of the bottom panel hingedly connected to the second long end of the third rectangular panel along an eighth fold line, the second long end of the bottom panel hingedly connected to a tuck flap along a ninth fold line, and the first and second short ends of the bottom panel being free ends; and the third rectangular panel having first, second and third score lines parallel to the first and second long ends of the third rectangular panel and first and second perforated lines extending from the first long end and perpendicular to the first, second and third score lines to form first, second and third foldable inner reinforcement sections which are located inside the display carton when the display carton is erected; wherein the glue flap is adapted to be glued to an inside of the second side flap so as to provide a carton blank in a folded condition which can be erected to form a merchandising display carton by folding the first and second side panels at an angle of 90° with respect to the second and third rectangular panels and form a rectangular opening between the first and second side panels and between the second and third rectangular panels, folding the first and second dust flaps by an angle of 90° with respect to the first and second side panels so as to overlie a bottom of the rectangular opening, folding the tuck flap by an angle of 90° with respect to the bottom flap and folding the bottom flap by an angle of 90° with respect to the third rectangular panel so as to overlie the bottom of the rectangular opening with the tuck flap against an inside of the second rectangular panel, and folding the first rectangular panel by an angle of 180° with respect to the second rectangular panel so as to be inside the rectangular opening against the second rectangular panel 20.

According to another embodiment, the carton blank further comprises a third perforated line in the first side panel, the third perforated line extending from the first short end of the first side panel to a fold line between the first side panel and the third rectangular panel; a fourth perforated line in the second side panel, the fourth perforated line extending from the first short end of the second side panel to a fold line between the second side panel and the third rectangular panel; a fifth perforated line extending between the fourth perforated line and the first perforated line; and a sixth perforated line extending between the second perforated line and the third perforated line, the first through sixth perforated lines allowing sections of the carton blank to be removed while leaving the three reinforcement sections, which fold about the first, second and third score lines such that the first reinforcement section abuts the second rectangular panel, the second reinforcement section abuts the bottom panel and the third reinforcement section abuts the third rectangular panel.

According to another embodiment, a method of erecting the glued and folded display carton comprises folding the first and second side panels at an angle of 90° with respect to the second and third rectangular panels and forming a rectangular opening between the first and second side panels and between the second and third rectangular panels; folding the first and second dust flaps by an angle of 90° with respect to the first and second side panels so as to overlie a bottom of the rectangular opening; folding the tuck flap by an angle of 90° with respect to the bottom flap; folding the bottom flap by an angle of 90° with respect to the third rectangular panel so as to overlie the bottom of the rectangular opening with the tuck flap against an inside of the second rectangular panel; folding the first rectangular panel by an angle of 180° with respect to the second rectangular panel so as to be inside the rectangular opening against the second rectangular panel; separating the first, second and third reinforcement sections from remaining portions of the carton blank by tearing the carton blank along the first and second perforation lines; folding the first reinforcement section 90° with respect to the second reinforcement section; folding the second reinforcement section 90° with respect to the third reinforcement section; folding the third reinforcement section 180° about the third score line such that the third reinforcement section abuts an inside of a lower portion of the third rectangular panel, the second reinforcement section abuts the bottom panel, and the first reinforcement section abuts a lower portion of the second rectangular panel.

BRIEF DESCRIPTION OF THE DRAWING FIGURES

DETAILED DESCRIPTION OF THE INVENTION

Figure 1:
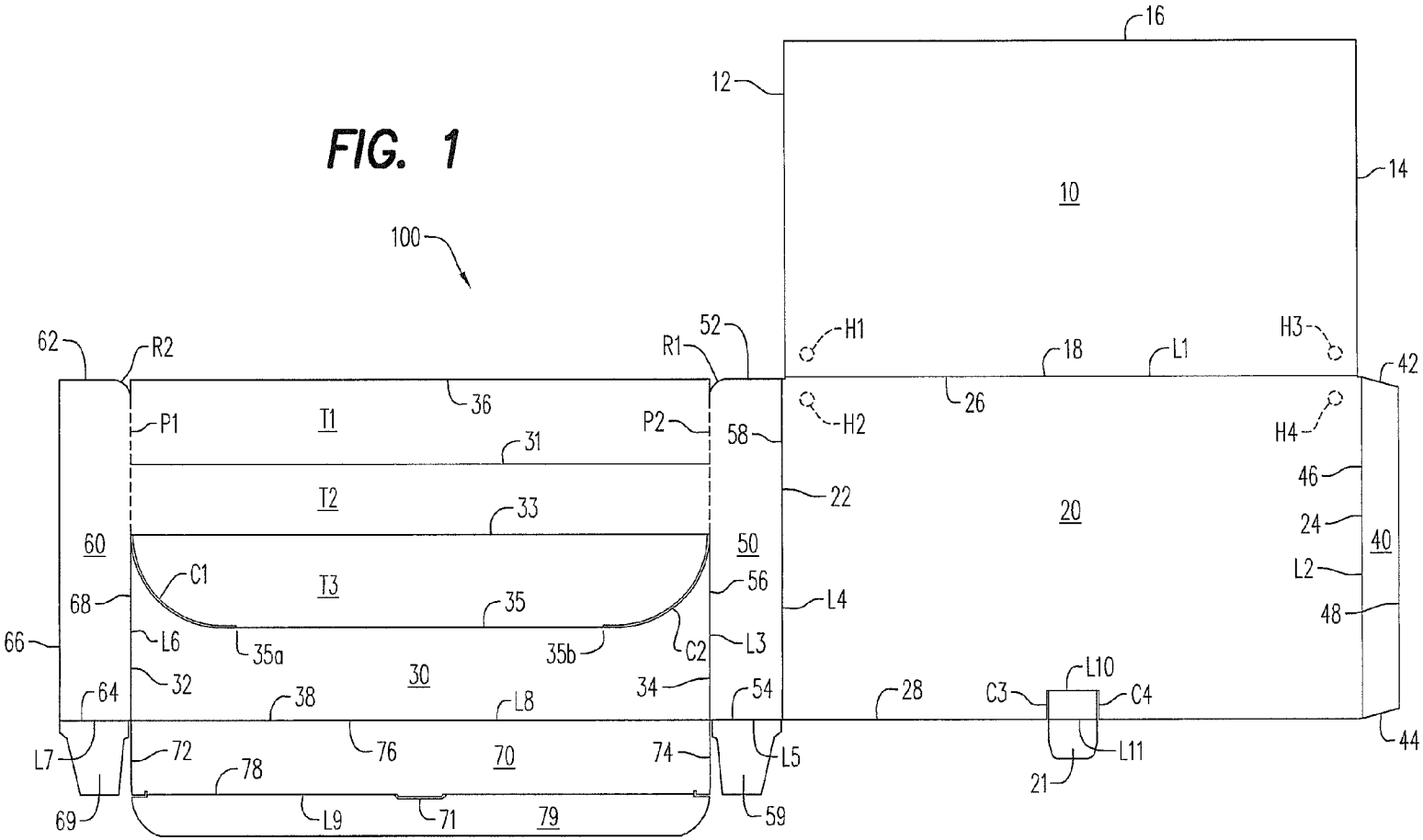
FIG. 1 shows a planar view of a blank for a merchandising unit in an unfolded state according to one embodiment.
Figure 2:
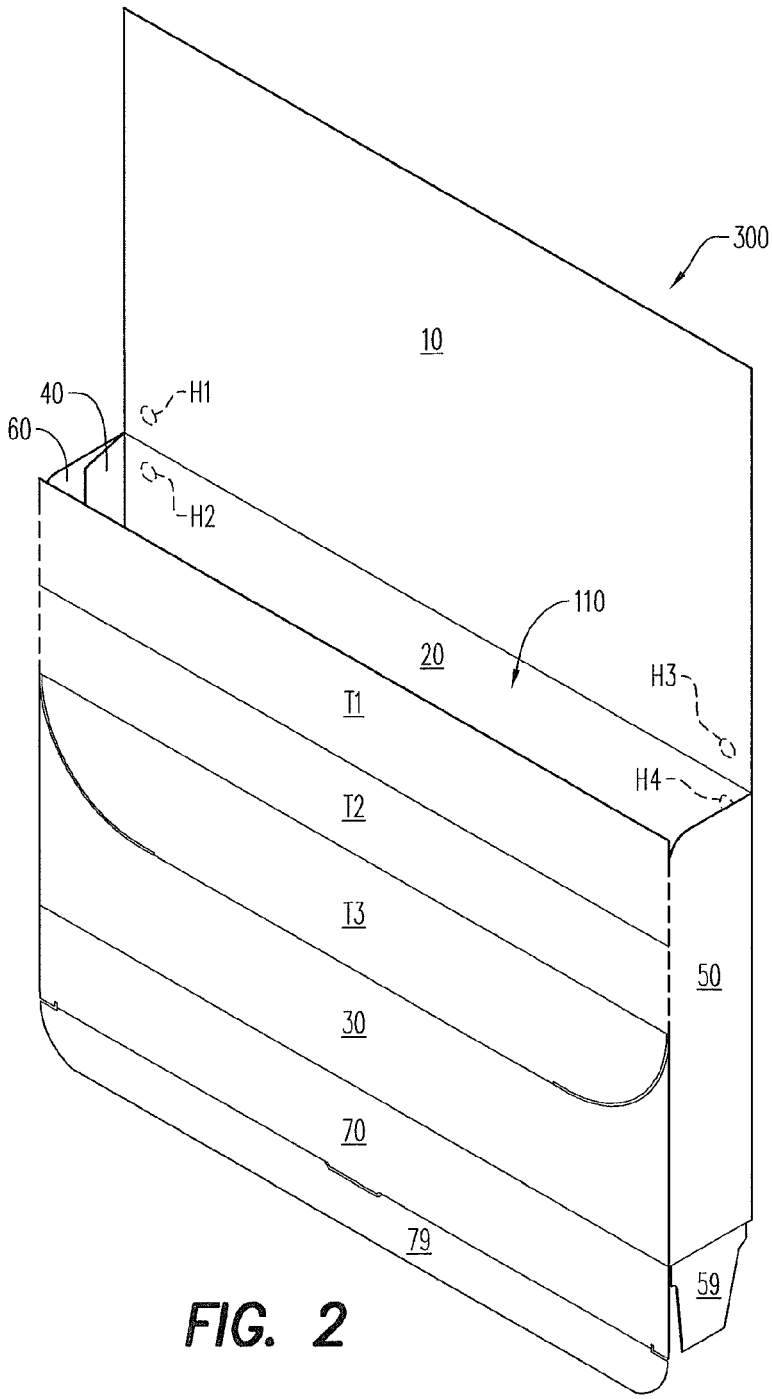
FIG. 2 shows a perspective view of the blank in a glued and folded state.

Referring to FIGS. 1-2, a carton blank 100 for a merchandising unit 300 is described herein. The blank 100 comprises a first (inner) back rectangular panel 10, a second (outer) back rectangular panel 20 and a third rectangular panel 30. The first rectangular panel 10 has first and second short ends 12, 14 and first and second long ends (or "edge portions") 16, 18, the first and second short ends 12, 14 being free ends and the first long end 16 being a free end. The second rectangular panel 20 has first and second short ends 22, 24 and first and second long ends 26, 28, the first long end 26 of the second rectangular panel being hingedly connected to the second long end 18 of the first rectangular panel 10 along a first fold line L1. The third rectangular panel 30 has first and second short ends 32, 34 and first and second long ends 36, 38.

The blank 100 further comprises a glue flap 40, a first side panel 50, a second side panel 60, and a bottom panel 70. The glue flap 40 has first and second short ends 42, 44 and first and second long ends 46, 48, the first long end 46 of the glue flap being hingedly connected to the second short end 24 of the second rectangular panel 20 along a second fold line L2, the second long end 48 being a free end, and the first and second short ends 42, 44 being free ends. The first side panel 50 has first and second short ends 52, 54 and first and second long ends 56, 58, the first long end 56 of the first side panel 50 being hingedly connected to the second short end 34 of the third rectangular panel 30 along a third fold line L3, the second long end 58 of the first side panel 50 being hingedly connected to the first short end 22 of the second rectangular panel 20 along a fourth fold line L4, and the second short end 54 of the first side panel 50 being hingedly connected to a first dust flap 59 along a fifth fold line L5 and the first short end 52 of the first side panel 50 being a free end. The second side panel 60 has first and second short ends 62, 64 and first and second long ends 66, 68, the second long end 68 of the second side panel 60 being hingedly connected to the first short end 32 of the third rectangular panel 30 along a sixth fold line L6, the second short end 64 of the second side panel 60 being hingedly connected to a second dust flap 69 along a seventh fold line L7 and the first short end 62 and first long end 66 of the second side panel 60 being free ends. The bottom panel 70 has first and second short ends 72, 74 and first and second long ends 76, 78, the first long end 76 of the bottom panel 70 being hingedly connected to the second long end 38 of the third rectangular panel 30 along an eighth fold line L8, the second long end 78 of the bottom panel 70 being hingedly connected to a tuck flap 79 along a ninth fold line L9, and the first and second short ends 72, 74 of the bottom panel 70 being free ends.

As shown best in FIG. 1, the third rectangular panel 30 has first, second and third score (fold) lines 31, 33, 35 extending transversely and parallel to the first and second long ends 36, 38 thereof in order to facilitate folding of the third rectangular panel 30 therealong, as described further below. The third rectangular panel 30 also includes first and second perforated lines P1, P2 extending from the first long end 36 and perpendicular to the first, second and third score (fold) lines 31, 33, 35 to form, when broken, first, second and third foldable inner reinforcement sections T1, T2, T3. The carton blank 100 further comprises first and second cut lines C1, C2 in the third rectangular panel 30, the first cut line C1 extending from the first perforated line P1 to one end 35*a* of the third score line 35 and the second cut line C2 extending from the second perforated line P2 to an opposite end 35*b* of the third score line 35, the perforated lines P1, P2 and the cut lines C1, C2 allowing the three reinforcement sections T1, T2, T3 to be separated from the first and second side panels 50, 60 and folded about the first, second and third score lines 31, 33, 35 such that the first reinforcement section T1 abuts the second rectangular panel 20, the second reinforcement section T2 abuts the bottom panel 70 and the third reinforcement section T3 abuts the third rectangular panel 30 when the unit is erected. The first, second and third reinforcement sections T1-T3, can thus be folded into the interior of the erected merchandising unit to provide, together with back panels 10 and 20 when folded, a double-wall thickness along the front, bottom and back portions of the unit.

The glue flap 40 is adapted to be glued to an inner or inside surface of the second side panel 60 so as to provide an erectable carton blank structure in a folded condition which can be erected to form the display carton or merchandising unit 300. Hence, the carton blank is configured to be readily glued and folded into a collapsed state to facilitate shipping to the sales force, and the collapsed unit is readily erected in the field. More particularly, fold lines L2, L3, L4 and L6 are preferably pre-broken by folding 180°, fold lines L4 and L6 are then folded 180° and glue flap 40 is glued to the inner surface of second side panel 60 to form a glued and folded blank structure. With reference to FIG. 2, the glued and folded blank 100 is erected by folding the first and second side panels 50, 60 at an angle of 90° with respect to the second and third rectangular panels 20, 30 to form a rectangular opening 110 between the first and second side panels 50, 60 and between the second and third rectangular panels 20, 30. Thereafter, the first and second dust flaps 59, 69 are folded by an angle of 90° with respect to the first and second side panels 50, 60 so as to overlie a bottom of the rectangular opening 110, the tuck flap 79 is folded by an angle of 90° with respect to the bottom flap 70 and the bottom flap 70 is folded by an angle of 90° with respect to the third rectangular panel 30 so as to overlie the bottom of the rectangular opening 110 with the tuck flap 79 against an inside of the second rectangular panel 20. The first rectangular panel 10 is then folded by an angle of 180° with respect to the second rectangular panel 20 so as to be inside the rectangular opening 110 and disposed against the second rectangular panel 20. The folded over first rectangular panel 10 thus provides a double wall thickness and additional strength and support to the back portion of the erected merchandising unit.

The carton blank 100 further comprises a locking tab 21 extending from the second long end 28 of the second rectangular panel 20 and a slit 71 along fold line L9 between the bottom panel 70 and the tuck flap 79. The locking tab 21 is configured to fit into the slit 71 when the carton blank is erected. The locking tab 21 is hingedly connected to the second rectangular panel about a tenth fold line L10 and is foldable about an eleventh fold line L11 parallel to the tenth fold line L10, the locking tab being defined by cut lines C3, C4 in the second rectangular panel extending between the tenth fold line L10 and the eleventh fold line L11.

The carton blank 100 further comprises a first hole H1 in the first rectangular panel 10 and a second hole H2 in the second rectangular panel 20, the first and second holes H1, H2 forming a first axially aligned mounting hole when the first rectangular panel 10 is folded over the second rectangular panel 20. Also shown are a third hole H3 in the first rectangular panel 10 and a fourth hole H4 in the second rectangular panel 20, the third and fourth holes H3, H4 forming a second axially aligned mounting hole when the first rectangular panel 10 is folded over the second rectangular panel 20. The first and second holes H1, H2 are equidistant to the first and fourth fold lines L1, L4 and the third and fourth holes H3, H4 are equidistant to the first and second fold lines L1, L2. The holes accommodate mounting the fully erected unit to be hung from hooks or wire.

The first side panel 50 includes a first rounded corner R1 extending between the second perforation line P2 and the first short end 52 of the first side panel 50 and the second side panel 60 includes a second rounded corner R2 extending between the first second perforation line P1 and the first short end 62 of the first side panel 60.

Figure 3:
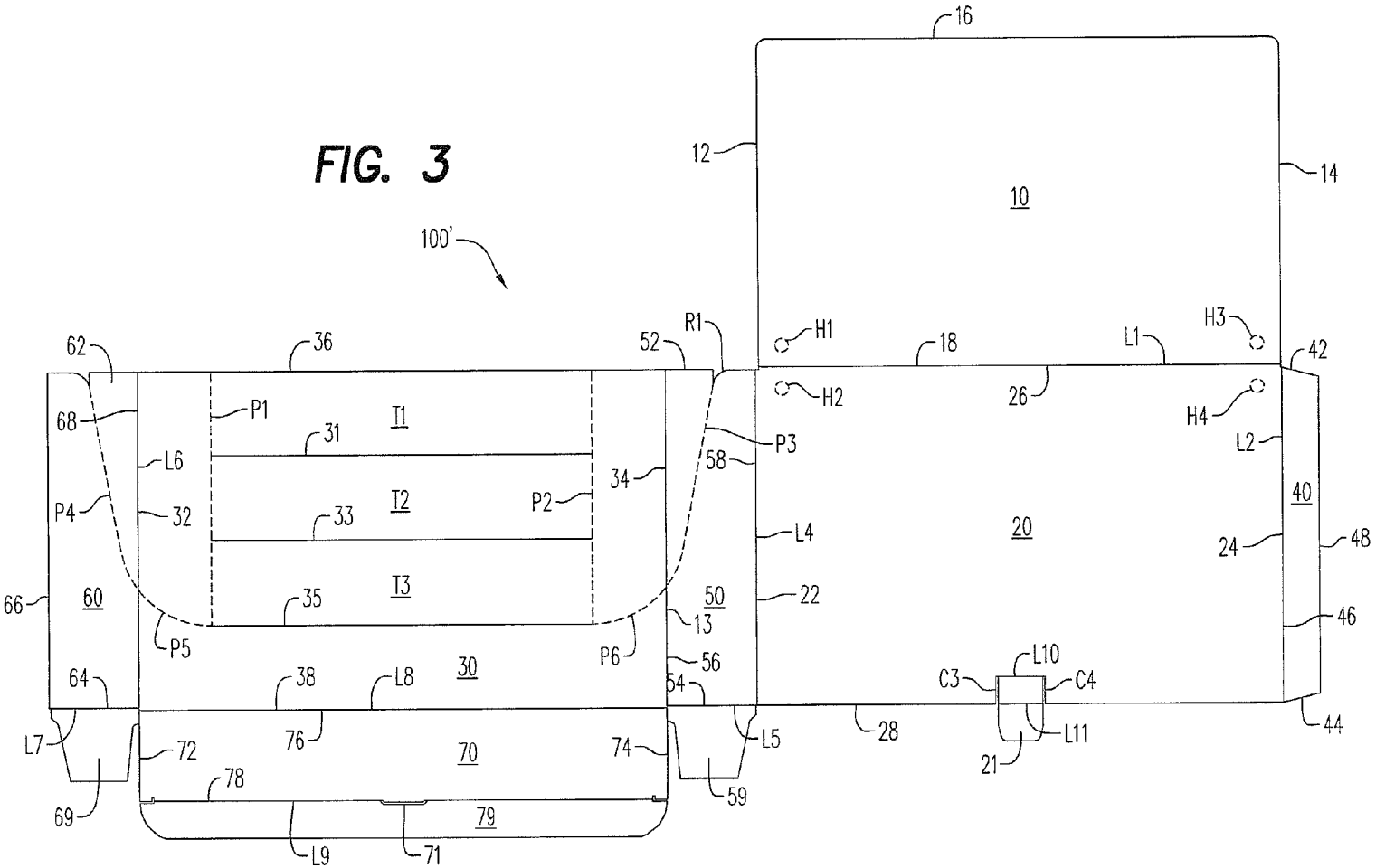
FIG. 3 shows a planar view of a blank for a merchandising unit in an unfolded state according to a further embodiment.

Referring to FIG. 3, a carton blank 100' according to another embodiment is shown, like reference numerals being used to refer to like elements shown in FIGS. 1-2. As in the previous embodiment, the blank 100' comprises a first (inner) rectangular panel 10, a second (outer) rectangular panel 20 and a third rectangular panel 30. The first rectangular panel 10 has first and second short ends (or "edge portions") 12, 14 and first and second long ends 16, 18, the first and second short ends 12, 14 being free ends and the first long end 16 being a free end. The second rectangular panel 20 has first and second short ends 22, 24 and first and second long ends 26, 28, the first long end 26 of the second rectangular panel being hingedly connected to the second long end 18 of the first rectangular panel 10 along a first fold line L1. The third rectangular panel 30 has first and second short ends 32, 34 and first and second long ends 36, 38.

The blank 100 further comprises a glue flap 40, a first side panel 50, a second side panel 60, and a bottom panel 70. The glue flap 40 has first and second short ends 42, 44 and first and second long ends 46, 48, the first long end 46 of the glue flap being hingedly connected to the second short end 24 of the second rectangular panel 20 along a second fold line L2, the second long end 48 being a free end, and the first and second short ends 42, 44 being free ends. The first side panel 50 has first and second short ends 52, 54 and first and second long ends 56, 58, the first long end 56 of the first side panel 50 being hingedly connected to the second short end 34 of the third rectangular panel 30 along a third fold line L3, the second long end 58 of the first side panel 50 being hingedly connected to the first short end 22 of the second rectangular panel 20 along a fourth fold line L4, and the second short end 54 of the first side panel 50 being hingedly connected to a first dust flap 59 along a fifth fold line L5 and the first short end 52 of the first side panel 50 being a free end. The second side panel 60 has first and second short ends 62, 64 and first and second long ends 66, 68, the second long end 68 of the second side panel 60 being hingedly connected to the first short end 32 of the third rectangular panel 30 along a sixth fold line L6, the second short end 64 of the second side panel 60 being hingedly connected to a second dust flap 69 along a seventh fold line L7 and the first short end 62 and first long end 66 of the second side panel 60 being free ends. The bottom panel 70 has first and second short ends 72, 74 and first and second long ends 76, 78, the first long end 76 of the bottom panel 70 being hingedly connected to the second long end 38 of the third rectangular panel 30 along an eight fold line L8, the second long end 78 of the bottom panel 70 being hingedly connected to a tuck flap 79 along a ninth fold line L9, and the first and second short ends 72, 74 of the bottom panel 70 being free ends.

Figure 5:
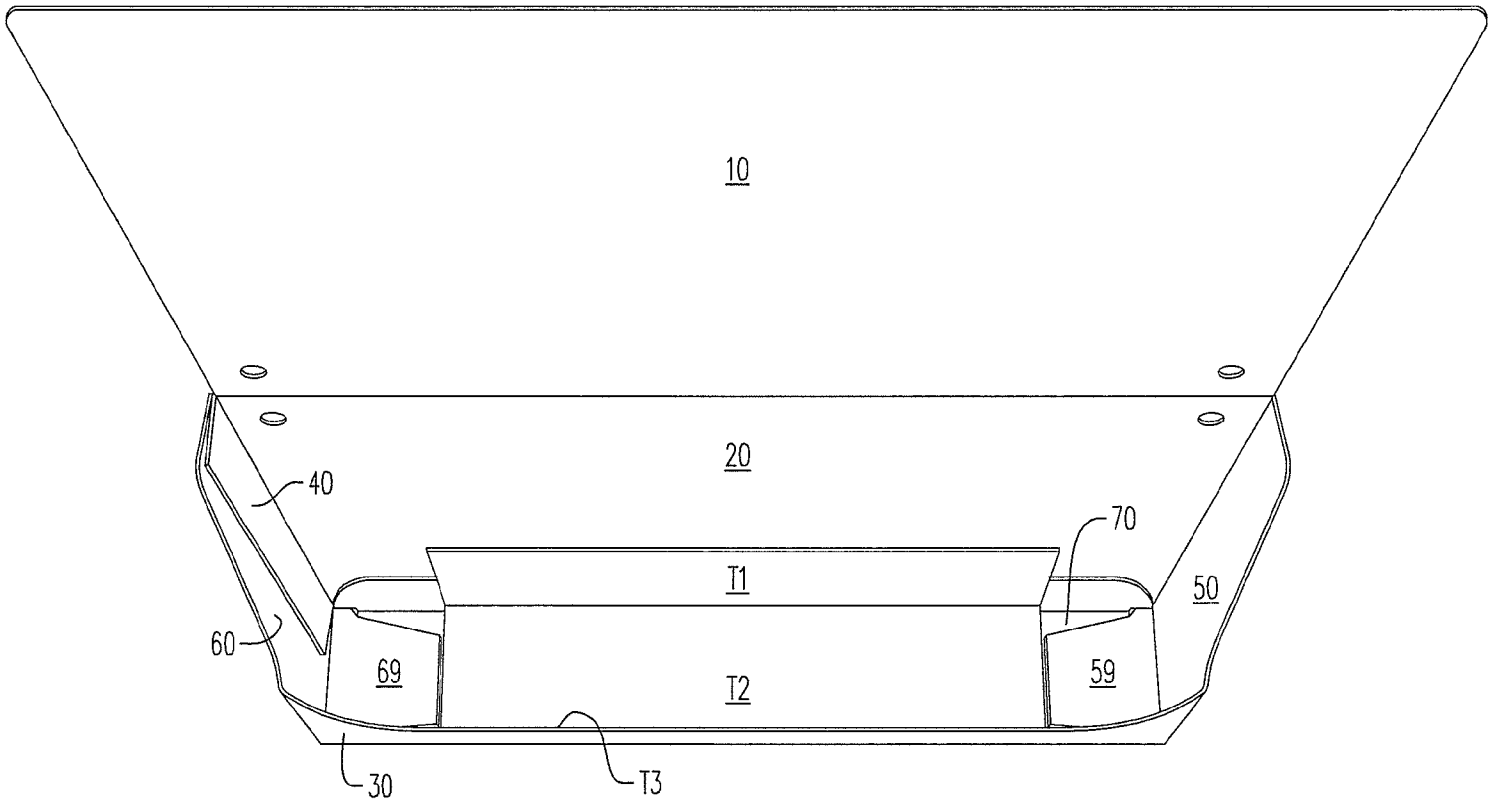
FIG. 5 shows the blank of FIG. 3 in a partially erected state of forming the merchandising unit.

As shown in FIG. 3, the third rectangular panel 30 has first, second and third score (fold) lines 31, 33, 35 extending transversely and parallel to the first and second long ends 36, 38 thereof in order to facilitate folding of the third rectangular panel 30 therealong, as described further below. The third rectangular panel 30 also includes first and second perforated lines P1, P2 extending from the first long end 36 and perpendicular to the first, second and third score (fold) lines 31, 33, 35 to form, when broken, first, second and third foldable inner reinforcement sections T1, T2, T3 which are located inside the display carton when the display carton is erected. Blank 100' further comprises a third perforated line P3 in the first side panel 50, the third perforated line P3 extending from the first short end 52 of the first side panel 50 to fold line L3 between the first side panel 50 and the third rectangular panel 30, a fourth perforated line P4 in the second side panel 60, the fourth perforated line P4 extending from the first short end 62 of the second side panel 60 to fold line L6 between the second side panel 60 and the third rectangular panel 30, a fifth perforated line P5 extending between the fourth perforated line P4 and the first perforated line P1, and a sixth perforated line P6 extending between the second perforated line P2 and the third perforated line P3. The perforated lines P1-P6 allow sections of the carton blank 100' to be completely removed while leaving the three reinforcement sections T1, T2, T3 to be folded about the first, second and third score lines 31, 33, 35 such that the first reinforcement section T1 abuts the second rectangular panel 20, the second reinforcement section T2 abuts the bottom panel 70 and the third reinforcement section T3 abuts the third rectangular panel 30 when the unit is erected, as shown in FIG. 5. The first, second and third reinforcement sections T1-T3, can thus be folded into the interior of the erected merchandising unit to provide, together with back panels 10 and 20 when folded, a double-wall thickness along the front, bottom and back portions of the unit.

The glue flap 40 is adapted to be glued to an inner or inside surface of the second side panel 60 so as to provide an erectable carton blank structure in a folded condition which can be erected to form the display carton or merchandising unit 300'. More particularly, fold lines L2, L3, L4 and L6 are preferably pre-broken by folding 180°, fold lines L4 and L6 are then folded 180° and glue flap 40 is glued to the inner surface of second side panel 60 to form a glued and folded blank structure. Hence, the carton blank is configured to be readily glued and folded into a collapsed state to facilitate shipping to the sales force, and the collapsed unit is readily erected in the field. The glued and folded blank 100' is erected by preferably first removing the panels defined by the perforated lines P1-P6. Thereafter, with reference also to FIG. 2, the blank 100' is similarly erected by folding the first and second side panels 50, 60 at an angle of 90° with respect to the second and third rectangular panels 20, 30 to form a rectangular opening 110 between the first and second side panels 50, 60 and between the second and third rectangular panels 20, 30. Thereafter, the first and second dust flaps 59, 69 are folded by an angle of 90° with respect to the first and second side panels 50, 60 so as to overlie a bottom of the rectangular opening 110, the tuck flap 79 is folded by an angle of 90° with respect to the bottom flap 70 and the bottom flap 70 is folded by an angle of 90° with respect to the third rectangular panel 30 so as to overlie the bottom of the rectangular opening 110 with the tuck flap 79 against an inside of the second rectangular panel 20. The first rectangular panel 10 is then folded by an angle of 180° with respect to the second rectangular panel 20 so as to be inside the rectangular opening 110 and disposed against the second rectangular panel 20. The folded over first rectangular panel 10 thus provides a double wall thickness and additional strength and support to the back portion of the erected merchandising unit.

The carton blank 100' further comprises a locking tab 21 extending from the second long end 28 of the second rectangular panel 20 and a slit 71 along fold line L9 between the bottom panel 70 and the tuck flap 79. The locking tab 21 is configured to fit into the slit 71 when the carton blank is erected. The locking tab 21 is hingedly connected to the second rectangular panel about a tenth fold line L10 and is foldable about an eleventh fold line L11 parallel to the tenth fold line L10, the locking tab being defined by cut lines C3, C4 in the second rectangular panel extending between the tenth fold line L10 and the eleventh fold line L11.

The carton blank 100' further comprising a first hole H1 in the first rectangular panel 10 and a second hole H2 in the second rectangular panel 20, the first and second holes H1, H2 forming a first axially aligned mounting hole when the first rectangular panel 10 is folded over the second rectangular panel 20. Also shown are a third hole H3 in the first rectangular panel 10 and a fourth hole H4 in the second rectangular panel 20, the third and fourth holes H3, H4 forming a second axially aligned mounting hole when the first rectangular panel 10 is folded over the second rectangular panel 20. The first and second holes H1, H2 are equidistant to the first and fourth fold lines L1, L4 and the third and fourth holes H3, H4 are equidistant to the first and second fold lines L1, L2.

The first side panel 50 includes a first rounded corner R1 extending between the third perforation line P3 and the first short end 52 of the first side panel 50 and the second side panel 60 includes a second rounded corner R2 extending between the fourth perforation line P4 and the first short end 62 of the first side panel 60.

A method of erecting a folded carton blank 100 according to one embodiment comprises folding the first and second side panels 50, 60 at an angle of 90° with respect to the second and third rectangular panels 20, 30 so as to form a rectangular opening 110 between the first and second side panels 50, 60 and between the second and third rectangular panels 20, 30. Thereafter, folding the first and second dust flaps 59, 69 by an angle of 90° with respect to the first and second side panels 50, 60 so as to overlie a bottom of the rectangular opening 110. The tuck flap 79 is then folded by an angle of 90° with respect to the bottom flap 70 and the bottom flap 70 is folded by an angle of 90° with respect to the third rectangular panel 30 so as to overlie the bottom of the rectangular opening 110 with the tuck flap 79 against an inside of the second rectangular panel 20. The first rectangular panel 10 is folded by an angle of 180° with respect to the second rectangular panel 20 so as to be inside the rectangular opening 110 against the second rectangular panel 20. The first, second and third reinforcement sections T1, T2, T3 are separated from the remaining portions of the carton blank 100 by breaking or tearing the carton blank along the first and second perforation lines P1, P2.

The method further comprises folding the first reinforcement section T1 90° with respect to the second reinforcement section T2; folding the second reinforcement section T2 90° with respect to the third reinforcement section T3; and folding the third reinforcement section T3 180° about the third score line 35 such that the third reinforcement section T3 abuts an inside of a lower portion of the third rectangular panel 30, the second reinforcement section T2 abuts the bottom panel 70, and the first reinforcement section T1 abuts a lower portion of the second rectangular panel 20. Preferably the first section T1 is disposed between the back panels 20 and 10 when the latter panel is folded down. In the alternative, section T1 may be disposed directly against the folded inner back panel 10. The method further comprises inserting the locking tab 21 into the slit 71.

A method of erecting a folded carton blank 100' according to one embodiment comprises folding the first and second side panels 50, 60 at an angle of 90° with respect to the second and third rectangular panels 20, 30 so as to form a rectangular opening 110 between the first and second side panels 50, 60 and between the second and third rectangular panels 20, 30. Thereafter, folding the first and second dust flaps 59, 69 by an angle of 90° with respect to the first and second side panels 50, 60 so as to overlie a bottom of the rectangular opening 110. The tuck flap 79 is then folded by an angle of 90° with respect to the bottom flap 70 and the bottom flap 70 is folded by an angle of 90° with respect to the third rectangular panel 30 so as to overlie the bottom of the rectangular opening 110 with the tuck flap 79 against an inside of the second rectangular panel 20. The first rectangular panel 10 is folded by an angle of 180° with respect to the second rectangular panel 20 so as to be inside the rectangular opening 110 against the second rectangular panel 20. The first, second and third reinforcement sections T1, T2, T3 are separated from the remaining portions of the carton blank 100 by tearing the carton blank 100' along the perforation lines P1-P6 and the material removed may be discarded.

Referring also to FIG. 5, the method further comprises folding the first reinforcement section T1 90° with respect to the second reinforcement section T2; folding the second reinforcement section T2 90° with respect to the third reinforcement section T3; and folding the third reinforcement section T3 180° about the third score line 35 such that the third reinforcement section T3 abuts an inside of a lower portion of the third rectangular panel 30, the second reinforcement section T2 abuts the bottom panel 70, and the first reinforcement section T1 abuts a lower portion of the second rectangular panel 20. The method further comprises inserting the locking tab 21 into the slit 71.

Figure 4:
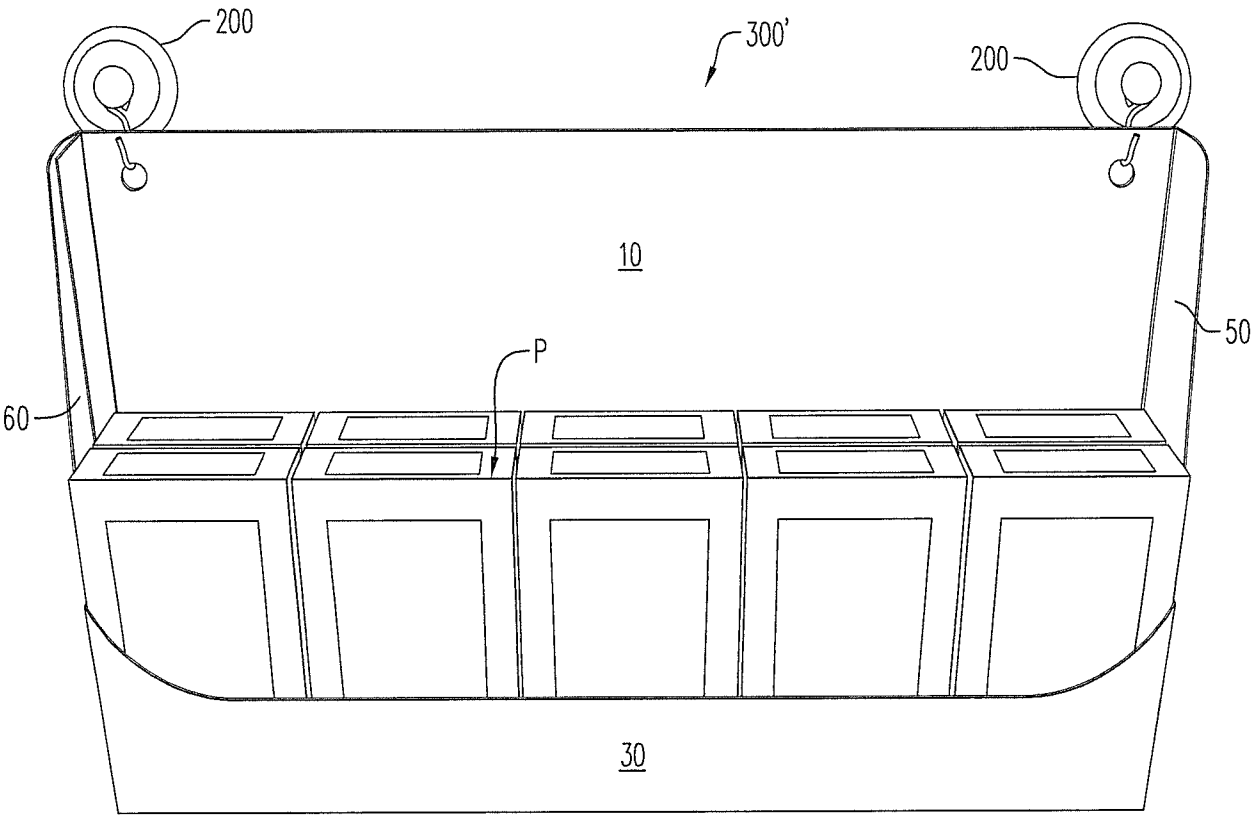
FIG. 4 shows the merchandising unit in an erected state.

When erected, as shown in FIGS. 4 and 5, the merchandising unit includes the glue flap 40 adhered to an inside of the second side flap 60, and the first and second side panels 50, 60 being at an angle of 90° with respect to the second and third rectangular panels 20, 30 to form a rectangular opening 110 between the first and second side panels 50, 60 and between the second and third rectangular panels 20, 30. The first and second dust flaps 59, 69 are at an angle of 90° with respect to the first and second side panels 50, 60 so as to overlie a bottom of the rectangular opening 110, the bottom flap 70 is at an angle of 90° with respect to the third rectangular panel 30 and overlies the bottom of the rectangular opening 110 with the tuck flap 79 at an angle of 90° with respect to the bottom panel 70 and against an inside of the second rectangular panel 20, and the first rectangular panel 10 is folded over the second rectangular panel 20 and located inside the rectangular opening 110 against the second rectangular panel 20.

Referring to FIGS. 1 and 5, the arcuate extent of cut lines C1 and C2 can be of sufficient length such that bottom section T2 may be disposed between dust flaps 59 and 69 so as to provide the unit with a bottom portion of generally uniform double thickness. Such arrangement promotes an even (level) display of product. Perforation (or cut) lines P5, P6 of FIG. 3 may be sized for similar purpose and effect. In the alternative, the arcuate extent of cut (perforated) lines C1 and C2 of FIG. 1 and the arcuate extent of perforated (or cut) lines P5 and P6 may be shortened so as to increase the transverse extent of the bottom section T2 and increase an overlap of section T2 over the dust flaps 59 and 69, to enhance rigidity of the display structure.

The merchandising unit or display carton provides a large area on first rectangular panel 10 on which advertisements or merchandising information can be displayed and be viewed above the product P when it is loaded into the carton. The merchandising unit can be displayed on a counter top or, alternatively, holes H1-H4 allow suction cups 200 or other securing means to be used to hang the merchandising unit on a wall surface. Still further, if the merchandising unit is going to be maintained within a kiosk or the like, a rear surface (not shown) of second rectangular panel 20 can be provided with desired advertisements or information. When the merchandising unit is disposed with the rear surface abutting a transparent wall or window, the advertisements or information is viewable to the consumer outside of the kiosk yet the product within the unit can only be accessed by the employee working within the kiosk.

While the above blank for the merchandising unit and method of forming the same have been described in detail with reference to specific embodiments thereof, it will be apparent to those skilled in the art that various changes and modifications can be made, and equivalents employed, without departing from the scope of the appended claims.

What is claimed is:

1. A display unit comprising:

a front panel, an outer back panel, a bottom panel and side panels;

a first connected reinforcing panel section, a second connected reinforcing panel section and a third connected reinforcing panel section folded into superposing relation to said outer back panel, said bottom panel and said front panel, respectively, such that a double-panel reinforcement is established on a portion of the display unit;

wherein said first, second and third connected reinforcing panel sections are also connected with said front panel along a first fold line defined between said front panel and said third connected reinforcing panel section;

an inner back panel connected and folded into superposing relation with said outer back panel along a second fold line; and wherein a depth of the display unit is defined between said front panel and said outer back panel and said second connected reinforcing panel section extends an entirety of the depth between said front panel and said outer back panel.

2. A method of establishing a double-panel reinforcement of a display unit, comprising:

providing a box structure comprising a front panel, an outer back panel an inner back panel, a bottom panel and side panels;

folding respective first, second and third connected reinforcing panel sections into superposing relation to said outer back panel, said bottom panel and said front panel, respectively, said folding including folding along a first fold line defined between said front panel and said third connected reinforcing panel section; and folding said inner back panel into superposing relation with said outer back panel along a second fold line therebetween.

3. The method as claimed in claim 2, further comprising at least partially establishing said first, second and third connected reinforcing panel sections by separating said first, second and third connected reinforcing panel sections from adjacent portions of said side panels.

4. A carton blank adapted to be glued and shipped in a folded condition and erected at a point of sale into a merchandising display carton, comprising:

a first rectangular panel having a first short end and a second short end and a first long end and a second long end, the first and second short ends being free ends and the first long end being a free end;

a second rectangular panel having a first short end and a second short end and a first long end and a second long end, the first long end of the second rectangular panel hingedly connected to the second long end of the first rectangular panel along a first fold line;

a third rectangular panel having a first short end and a second short end and a first long end and a second long end;

a glue flap having a first short end and a second short end and a first long end and a second long end, the first long end of the glue flap hingedly connected to the second short end of the second rectangular panel along a second fold line, the second long end being a free end, and the first and second short ends being free ends;

a first side panel having a first short end and a second short end and a first long end and a second long end, the first long end of the first side panel hingedly connected to the second short end of the third rectangular panel along a third fold line, the second long end of the first side panel hingedly connected to the first short end of the second rectangular panel along a fourth fold line, the second short end of the first side panel hingedly connected to a first dust flap along a fifth fold line and the first short end of the first side panel being a free end;

a second side panel having a first short end and a second short end and a first long end and a second long end, the second long end of the second side panel hingedly connected to the first short end of the third rectangular panel along a sixth fold line, the second short end of the second side panel hingedly connected to a second dust flap along a seventh fold line and the first short end and first long end of the second side panel being free ends;

a bottom panel having a first short end and a second short end and a first long end and a second long end, the first long end of the bottom panel hingedly connected to the second long end of the third rectangular panel along an eighth fold line, the second long end of the bottom panel hingedly connected to a tuck flap along a ninth fold line, and the first and second short ends of the bottom panel being free ends; and the third rectangular panel having first, second and third score lines parallel to the first and second long ends of the third rectangular panel and a first perforated line and a second perforated line extending from the first long end of the third rectangular panel and perpendicular to the first, second and third score lines to form a first foldable inner reinforcement section, a second foldable inner reinforcement section and a third foldable inner reinforcement section which are located inside the display carton when the display carton is erected;

wherein the glue flap is adapted to be glued to an inside of the second side panel so as to provide a carton blank in a folded condition which can be erected to form a merchandising display carton by folding the first and second side panels at an angle of 90° with respect to the second and third rectangular panels and form a rectangular opening between the first and second side panels and between the second and third rectangular panels, folding the first and second dust flaps by an angle of 90° with respect to the first and second side panels so as to overlie a bottom of the rectangular opening, folding the tuck flap by an angle of 90° with respect to the bottom flap and folding the bottom flap by an angle of 90° with respect to the third rectangular panel so as to overlie the bottom of the rectangular opening with the tuck flap against an inside of the second rectangular panel, and folding the first rectangular panel by an angle of 180° with respect to the second rectangular panel so as to be inside the rectangular opening against the second rectangular panel.

5. The carton blank of claim 4, further comprising a locking tab extending from the second long end of the second rectangular panel and a slit along a fold line between the bottom panel and the tuck flap, the locking tab configured to fit into the slit when the carton blank is erected.

6. The carton blank of claim 5, wherein the locking tab is hingedly connected to the second rectangular panel about a tenth fold line and is foldable about an eleventh fold line parallel to the tenth fold line, the locking tab being defined by third and fourth cut lines in the second rectangular panel extending between the tenth fold line and the eleventh fold line.

7. The carton blank of claim 4, further comprising a third perforated line in the first side panel, the third perforated line extending from the first short end of the first side panel to a fold line between the first side panel and the third rectangular panel; a fourth perforated line in the second side panel, the fourth perforated line extending from the first short end of the second side panel to a fold line between the second side panel and the third rectangular panel; a fifth perforated line extending between the fourth perforated line and the first perforated line; and a sixth perforated line extending between the second perforated line and the third perforated line, the first through sixth perforated lines allowing sections of the carton blank to be removed while leaving the three foldable inner reinforcement sections, which fold about the first, second and third score lines such that the first foldable inner reinforcement section abuts the second rectangular panel, the second foldable inner reinforcement section abuts the bottom panel and the third foldable inner reinforcement section abuts the third rectangular panel.

8. The carton blank of claim 4, further comprising a first cut line and a second cut line in the third rectangular panel, the first cut line extending from the first perforated line to one end of the third score line and the second cut line extending from the second perforated line to an opposite end of the third score line, the first and second perforated lines and the first and second cut lines allowing the three foldable inner reinforcement sections to be separated from the first and second side panels and folded about the first, second and third score lines such that the first reinforcement section abuts the second rectangular panel, the second reinforcement section abuts the bottom panel and the third reinforcement section abuts the third rectangular panel.

9. The carton blank of claim 4, further comprising a first hole in the first rectangular panel and a second hole in the second rectangular panel, the first and second holes forming a first axially aligned mounting hole when the first rectangular panel is folded over the second rectangular panel.

10. The carton blank of claim 9, further comprising a third hole in the first rectangular panel and a fourth hole in the second rectangular panel, the third and fourth holes forming a second axially aligned mounting hole when the first rectangular panel is folded over the second rectangular panel.

11. The carton blank of claim 9, wherein the first and second holes are equidistant to the first and fourth fold lines and the third and fourth holes are equidistant to the first and second fold lines.

12. The carton blank of claim 4, wherein the first side panel includes a first rounded corner extending between the second perforation line and the first short end of the first side panel and the second side panel includes a second rounded corner extending between the first perforation line and the first short end of the first side panel.

13. A folded merchandising unit comprising:

a first rectangular panel having a first short end and a second short end and a first long end and a second long end, the first and second short ends being free ends and the first long end being a free end;

a second rectangular panel having a first short end and a second short end and a first long end and a second long end, the first long end of the second rectangular panel hingedly connected to the second long end of the first rectangular panel along a first fold line;

a third rectangular panel having a first short end and a second short end and a first long end and a second long end;

a glue flap having a first short end and a second short end and a first long end and a second long end, the first long end of the glue flap hingedly connected to the second short end of the second rectangular panel along a second fold line, the second long end being a free end, and the first and second short ends being free ends;

a first side panel having a first short end and a second short end and a first long end and a second long end, the first long end of the first side panel hingedly connected to the second short end of the third rectangular panel along a third fold line, the second long end of the first side panel hingedly connected to the first short end of the second rectangular panel along a fourth fold line, the second short end of the first side panel hingedly connected to a first dust flap along a fifth fold line and the first short end of the first side panel being a free end;

a second side panel having a first short end and a second short end and a first long end and a second long end, the second long end of the second side panel hingedly connected to the first short end of the third rectangular panel along a sixth fold line, the second short end of the second side panel hingedly connected to a second dust flap along a seventh fold line and the first short end and first long end of the second side panel being free ends;

a bottom panel having a first short end and a second short end and a first long end and a second long end, the first long end of the bottom panel hingedly connected to the second long end of the third rectangular panel along an eighth fold line, the second long end of the bottom panel hingedly connected to a tuck flap along a ninth fold line, and the first and second short ends of the bottom panel being free ends;

the third rectangular panel having first, second and third score lines parallel to the first and second long ends of the third rectangular panel and a first perforated line and a second perforated line extending from the first long end of the third rectangular panel and perpendicular to the first, second and third score lines to form first, second and third foldable inner reinforcement sections which are located inside the display carton;

wherein the glue flap is adhered to an inside of the second side panel, the first and second side panels are at an angle of 90° with respect to the second and third rectangular panels and form a rectangular opening between the first and second side panels and between the second and third rectangular panels, the first and second dust flaps are at an angle of 90° with respect to the first and second side panels so as to overlie a bottom of the rectangular opening, the bottom flap is at an angle of 90° with respect to the third rectangular panel and overlies the bottom of the rectangular opening with the tuck flap at an angle of 90° with respect to the bottom panel and against an inside of the second rectangular panel, and the first rectangular panel is folded over the second rectangular panel and located inside the rectangular opening against the second rectangular panel.

14. A method of erecting a folded carton blank comprising (a) a first rectangular panel having a first short end and a second short end and a first long end and a second long end, the first and second short ends being free ends and the first long end being a free end, (b) a second rectangular panel having a first short end and a second short end and a first long end and a second long end, the first long end of the second rectangular panel hingedly connected to the second long end of the first rectangular panel along a first fold line, (c) a third rectangular panel having a first short end and a second short end and a first long end and a second long end, (d) a glue flap having a first short end and a second short end and a first long end and a second long end, the first long end of the glue flap hingedly connected to the second short end of the second rectangular panel along a second fold line, the second long end being a free end, and the first and second short ends being free ends, (e) a first side panel having a first short end and a second short end and a first long end and a second long end, the first long end of the first side panel hingedly connected to the second short end of the third rectangular panel along a third fold line, the second long end of the first side panel hingedly connected to the first short end of the second rectangular panel along a fourth fold line, the second short end of the first side panel hingedly connected to a first dust flap along a fifth fold line and the first short end of the first side panel being a free end, (f) a second side panel having a first short end and a second short end and a first long end and a second long end, the second long end of the second side panel hingedly connected to the first short end of the third rectangular panel along a sixth fold line, the second short end of the second side panel hingedly connected to a second dust flap along a seventh fold line, the first short end and first long end of the second side panel being free ends and the second side panel adhered to the glue panel, (g) a bottom panel having a first short end and a second short end and a first long end and a second long end, the first long end of the bottom panel hingedly connected to the second long end of the third rectangular panel along an eighth fold line, the second long end of the bottom panel hingedly connected to a tuck flap along a ninth fold line, and the first and second short ends of the bottom panel being free ends, and (h) the third rectangular panel having first, second and third score lines parallel to the first and second long ends of the third rectangular panel and a first perforated line and a second perforated line extending from the first long end and perpendicular to the first, second and third score lines to form a first foldable inner reinforcement section, a second foldable inner reinforcement section and a third foldable inner reinforcement sections, the method comprising:

folding the first and second side panels at an angle of 90° with respect to the second and third rectangular panels and forming a rectangular opening between the first and second side panels and between the second and third rectangular panels;

folding the first and second dust flaps by an angle of 90° with respect to the first and second side panels so as to overlie a bottom of the rectangular opening;

folding the tuck flap by an angle of 90° with respect to the bottom flap;

folding the bottom flap by an angle of 90° with respect to the third rectangular panel so as to overlie the bottom of the rectangular opening with the tuck flap against an inside of the second rectangular panel;

folding the first rectangular panel by an angle of 180° with respect to the second rectangular panel so as to be inside the rectangular opening against the second rectangular panel;

separating the first, second and third reinforcement sections from remaining portions of the carton blank by tearing the carton blank along the first and second perforation lines;

folding the first reinforcement section 90° with respect to the second reinforcement section;

folding the second reinforcement section 90° with respect to the third reinforcement section;

folding the third reinforcement section 180° about the third score line such that the third reinforcement section abuts an inside of a lower portion of the third rectangular panel, the second reinforcement section abuts the bottom panel, and the first reinforcement section abuts a lower portion of the second rectangular panel.

15. The method of claim 14, wherein the carton blank further comprises a locking tab extending from the second long end of the second rectangular panel and a slit along a fold line between the bottom panel and the tuck flap, the method further comprising inserting the locking tab into the slit.

16. The method of claim 15, wherein the locking tab is hingedly connected to the second rectangular panel about a tenth fold line and is foldable about an eleventh fold line parallel to the tenth fold line, the locking tab being defined by third and fourth cut lines in the second rectangular panel extending between the tenth fold line and the eleventh fold line, the method further comprising:

folding the locking tab 90° about the eleventh fold line when the locking tab is inserted in the slit.

17. The method of claim 14, wherein the carton blank further comprises a third perforated line in the first side panel, the third perforated line extending from the first short end of the first side panel to a fold line between the first side panel and the third rectangular panel; a fourth perforated line in the second side panel, the fourth perforated line extending from the first short end of the second side panel to a fold line between the second side panel and the third rectangular panel, a fifth perforated line extending between the fourth perforated line and the first perforated line, and a sixth perforated line extending between the second perforated line and the third perforated line, the method further comprising:

tearing the carton blank along the first through sixth perforated lines to remove sections of the carton blank while leaving the three reinforcement sections free to fold about the first, second and third score lines such that the first reinforcement section abuts the second rectangular panel, the second reinforcement section abuts the bottom panel and the third reinforcement section abuts the third rectangular panel.

18. The method of claim 14, wherein the carton blank further comprises a first cut line and a second cut line in the third rectangular panel, the first cut line extending from the first perforated line to one end of the third score line and the second cut line extending from the second perforated line to an opposite end of the third score line, the method further comprising:

tearing the carton blank along the first and second perforated lines and separating portions of the carton blank along the first and second cut lines such that the three reinforcement sections are separated from the first and second side panels and are free to be folded about the first, second and third score lines such that the first reinforcement section abuts the second rectangular panel, the second reinforcement section abuts the bottom panel and the third reinforcement section abuts the third rectangular panel.

19. The method of claim 14, wherein the carton blank further comprises a first hole in the first rectangular panel and a second hole in the second rectangular panel, the method further comprising:

aligning the first and second holes to form a first axially aligned mounting hole when the first rectangular panel is folded over the second rectangular panel.

20. The method of claim 19, wherein the carton blank further comprises a third hole in the first rectangular panel and a fourth hole in the second rectangular panel, the method further comprising:

aligning the third and fourth holes to form a second axially aligned mounting hole when the first rectangular panel is folded over the second rectangular panel.

21. The method of claim 20, wherein the first and second holes are equidistant to the first and fourth fold lines and the third and fourth holes are equidistant to the first and second fold lines.

22. The method of claim 14, wherein the first side panel includes a first rounded corner extending between the second perforation line and the first short end of the first side panel and the second side panel includes a second rounded corner extending between the first perforation line and the first short end of the first side panel.

* * * * *